US005628063A

United States Patent [19]

Reed

[11] Patent Number: 5,628,063

[45] Date of Patent: May 13, 1997

[54] KNEE PAD ASSEMBLY

[76] Inventor: Wendal T. Reed, 3734 W. K-15 Ave., Lancaster, Calif. 93536

[21] Appl. No.: 573,330

[22] Filed: Dec. 15, 1995

[51] Int. Cl.[6] ..... A41D 13/00

[52] U.S. Cl. ..... 2/22

[58] Field of Search ..... 2/22, 23, 24, 267, 2/2

[56] References Cited

U.S. PATENT DOCUMENTS

| | | | |
|---|---|---|---|
| 4,627,108 | 12/1986 | Järvinen | 2/24 X |
| 4,700,406 | 10/1987 | Meistrell | 2/22 |
| 5,077,837 | 1/1992 | Meistrell | 2/22 X |
| 5,423,087 | 6/1995 | Krent et al. | 2/267 X |
| 5,452,475 | 9/1995 | Hunt | 2/22 |

*Primary Examiner*—Paul C. Lewis
*Attorney, Agent, or Firm*—Beehler & Pavitt

[57] ABSTRACT

A pad assembly for use as a protective device to protect from certain types of injury includes an outer shell including an upper and lower shell member. The upper shell is configured to fit over a specified portion of a person's body, such as the knee or elbow, and the lower shell is configured to fit over another portion of a person's body, such as the leg or forearm. The shells are joined together for relative hinged movement whereby the lower shell may be flexed while the upper shell remains in place. Foam padding is received on the side of said shell member facing the person's body and includes a peripheral portion extending beyond the shell member. A cloth member overlies the foam padding on the surface thereof spaced from the shell member and facing the person's body. The cloth member includes an elastic portion adapted to fit over the foam padding and the peripheral portion thereof which extends beyond the shell member. The shell member and assembled foam padding and cloth member are releasably secured in place to protect from abrasions and the like.

10 Claims, 2 Drawing Sheets

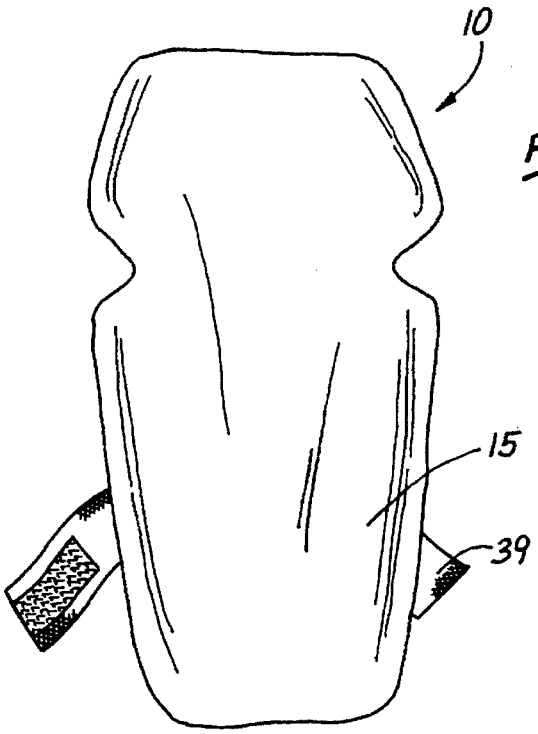
Fig. 2
Fig. 4
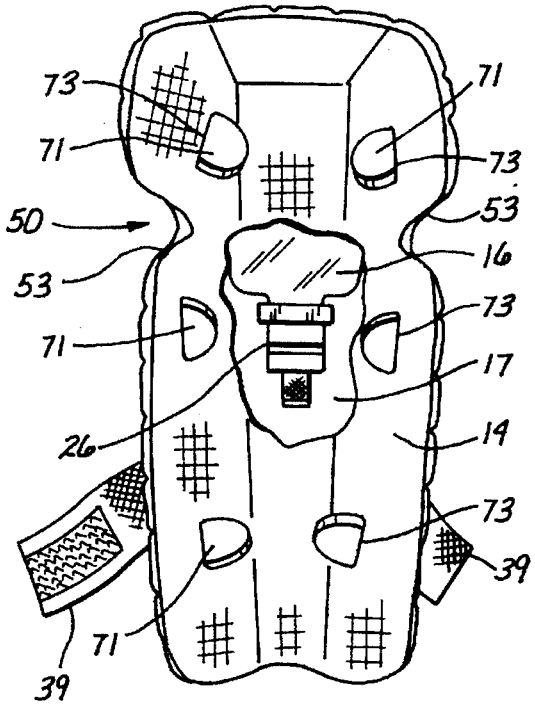
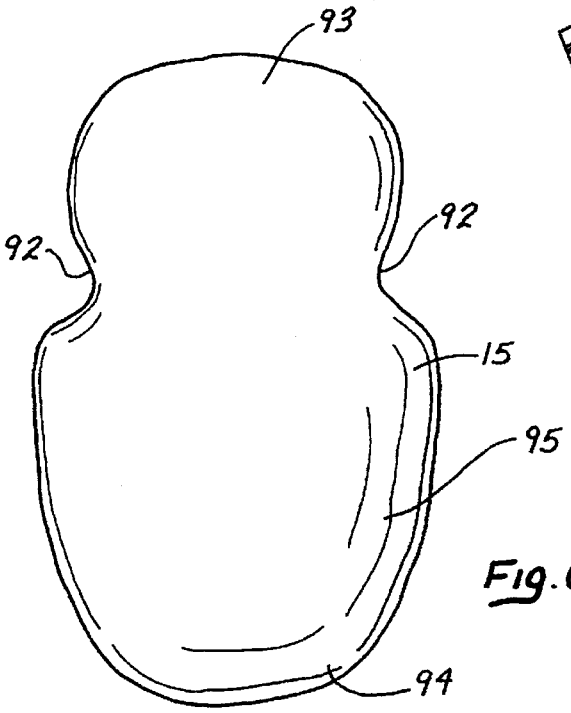
Fig. 6

KNEE PAD ASSEMBLY

BACKGROUND OF THE INVENTION

1. Field of Invention

The present invention relates to a protective pad assembly and more particularly to an improved knee or elbow pad assembly for use by off road motorcycle riders and riders of other types of devices and others in which protection against abrasion and the like is desired.

2. Description of the Prior Art

For those involved in off road motorcycle sports, or in-line roller skating or mountain bike riders and cross-country bicycle riders, and others, both adult and children, there exists a need for improved protective padding such as a knee pad and an elbow pad. Conventional knee and elbow pads are a form of protective gear intended to increase the user's safety by minimizing injury on impact. One of the areas most frequently injured due to scrapes and cuts is the knee and the portion of the leg below the knee as well as the elbow and arm between the elbow and wrist.

While knee and elbow pads are described as protecting against injury, it should be understood that the protection is limited and the use of knee or elbow pads does not assure that injury will not occur. In short the use of knee and/or elbow pads is likely to reduce the severity of an injury and to that extent, knee and/or elbow pads are useful as protective gear.

In some cases, riding pants are worn and knee pads are inserted in pockets in the pants. For many reasons, the use of separate knee pads has grown due to problems associated with pads inserted in pockets in riding pants. In some cases, the rider or sportsperson does not wear riding pants due to heat or discomfort or both, but knee protection is still sought and desirable. In the latter case, the knee pads are separate items placed over the knee rather than in a pocket provided in riding pants. It is to these separate knee pads that this invention relates.

Typically such conventional knee pads include an outer hard outer plastic shell portion usually composed of two major parts. The lower part fits over the portion of the leg immediately below the knee and the upper part, normally separate and hinged to the lower part, fits over the knee itself. The lower part is transversely curved so that there is a portion along the outer face of the leg and a portion which encircles a portion of the inner and outer portion of the leg. The joint between the lower and upper portions is an overlapping joint with the lower portion covering the upper portion at its lower extremity. In this way, even if the leg is bent, the knee remains protected as well as the portion immediately below the knee.

The hinge permits movement of the leg below the knee and the lower portion of the shell while still providing protection for the knee itself since the upper portion of the shell remains over the knee. To facilitate this movement in a bending fashion, there is a generally V-shaped space between the bottom side edge of each side of the upper portion and the opposed side edge of the lower portion. In effect the side edges of the lower portion are inclined downwardly while the lower edges of the upper portion are inclined upwardly.

Depending on the style and structure, there is also provided an inner cushion device joined to the outer shell by any one of several different attachment devices each well known. The cushion device is typically in the form of a foam member which extends below the lower end of the lower shell, laterally beyond the side edges of the lower shell and laterally beyond the side of the upper shell. The foam cushion is normally of one piece, about ½ inches or so in thickness although this may vary. The portion of the foam member in the region of the upper portion of the lower shell and in the region of the lower portion of the upper shell includes V-shaped spaces generally corresponding to the V-shaped spaces of the outer shells, already described. In one form the foam pad includes a series of spaced slots arranged in vertical orientation and receive tabs from the upper and lower shell to hold the foam in place. Other forms of attachment of the shells to the foam are also known. To secure the knee pad in place, a strap is used on one end of which is hook elements and the other end of which is loop elements, such as that available under the mark VELCRO.

Unfortunately, those involved in riding sports of the type described, neglect to wear knee pads since they are uncomfortable, especially if worn over bare skin. The discomfort arises for many reasons such as odor due to long use, the odor arising because of perspiration absorbed in the foam pad or cushion. It is not uncommon for knee pads to be used for an entire day. If soiled or smelly, it is difficult to clean the foam member since the latter is foam and it is difficult to remove all the moisture once it penetrates the foam.

Other sources of discomfort are the rubbing of the foam member against the skin of the leg or knee or elbow and arm, especially since the foam may not be smooth. Further, dried perspiration which when wetted during subsequent use may create itching or irritation. In addition, perspiration may permit the pad to move or slip relative to the leg and/or knee or elbow and arm.

The effect of the discomfort which results is that many sportspersons avoid the use of knee and/or elbow pads to protect them from certain types of injury. An abrasion of the knee and/or elbow is not only painful but heals with difficulty due to the constant flexure of the knee and/or elbow in normal activities.

It is thus apparent that a need exists for an improved protective pad assembly which overcomes the problems discussed above, which is relatively simple in structure and which may be used as a separate knee and/or elbow pad structure to provide the advantages to be discussed.

SUMMARY OF THE INVENTION

The present invention relates to an improved protective pad assembly which offers protection to the user by reducing injuries in such sports as cross-country motorcycling, cycling and the like and any other activity which requires the safeguard of protection to the knees and/or elbow with respect to abrasion and related types of injuries.

For purposes of simplicity, the invention will be described with respect to a knee pad assembly, although it is understood that the protective pad assembly of this invention is not limited thereto.

The improved knee pad assembly of this invention includes an outer shell member which includes an upper and lower shell member. The upper shell is configured to fit over a person's knee and the lower shell is configured to fit over the portion of a person's leg below the knee. The shells are held together for relative hinged movement whereby the leg below the knee may be flexed while the upper shell remains over the knee.

Foam padding is located on the side of the shell member which is spaced from the knee and the leg, i.e., between the inside of the shell member and the skin of the knee and leg.

The foam padding preferably includes a peripheral portion extending beyond the periphery of the shell member. A cloth member overlies the foam padding on the surface thereof spaced from shell member, the cloth means being located between the skin of the knee and leg and the inside surface of the foam padding. In a preferred form, the cloth member includes a portion adapted to fit over the foam padding and a peripheral portion which extends beyond the shell member. The cloth member includes a portion which covers the upper shell and a lower portion which includes a peripheral border around the foam padding in the lower shell region. Finally, the knee pad assembly includes a fastening device to releasably secure the shell member and assembled foam padding and cloth to a wearer's leg and knee.

In a preferred form, the cloth is a soft cloth similar to that used in sweat shirts in which one surface (the inner surface) is relatively soft and comfortable material. Fleece fabric may also be used. In this preferred form, the upper portion of the cloth member includes an upper pocket which essentially completely covers the upper shell which overlies the knee in order to hold the cloth member in the proper position and orientation. In this way, folds and wrinkles are avoided and the cloth member does not shift relative to the knee pad shell and foam members.

One of the advantages of this invention is that it may be used with a variety of different knee pad structures and easily assembled thereto. For example, there are a number of commercially available knee pad-foam pad structures currently available but which do not include the cloth member which offers the vast improvement to the knee pad assembly in accordance with this invention. Improving the knee pad assembly from the standpoint of comfort has the added benefit of encouraging persons to use a knee pad for protection where otherwise that person would not use a protective knee pad due to some level of discomfort.

It is thus an object of the present invention to provide an improved knee pad assembly which is comfortable to wear, inexpensive to manufacture and effective as a protective device.

Another object of this invention is to provide an improved knee pad assembly for use as a protective device which is easy to clean, reduces abrasion and tends to minimize irritation.

These and other objects of this invention are achieved and obtained by virtue of the device hereinafter disclosed with reference to the accompanying drawings which ar for purpose of illustration only and should not be viewed as limiting the present invention.

DESCRIPTION OF THE DRAWINGS

FIG. 2 is a view similar to FIG. 1 but seen from the reverse side of FIG. 1;

FIG. 4 is a view similar to FIG. 2 with the cloth cover removed;

FIG. 6 is a view from the reverse side of the cloth cover of FIG. 6 illustrating the portions that overlie the upper and lower shells.

DETAILED DESCRIPTION OF A PREFERRED EMBODIMENT

Figure 1:
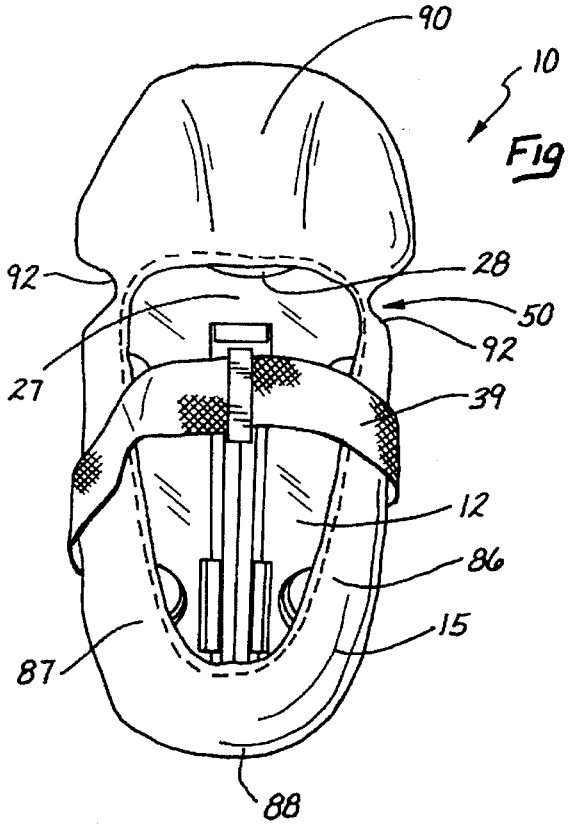
FIG. 1 is a front view in perspective of the improved protective pad assembly, in the form of knee pad assembly in accordance with this invention.

Referring to the drawings which illustrate a preferred form of the present invention, FIGS. 1 and 2 illustrate the improved protective pad assembly in the form of a knee pad assembly 10 in accordance with the present invention. It is understood that the same basic structure may be used as an elbow pad and the like.

As illustrated the assembly 10 is intended for use as a protective device for the knee area and portion of the leg below the knee and basically includes an outer shell member 12 which faces away from the leg and knee.

Supported by the shell member 12 and position on the interior of the shell is a padding member 14 (FIG. 3) in the form of a shock absorbing foam or similar shock absorbing material. Overlying the padding and facing the knee and leg is a cloth member 15, the latter being of a relative soft cloth similar to that used in sweat shirts, i.e., the inner face of the cloth member is of basically the same soft texture as the inside of s sweat shirt.

Figure 3:
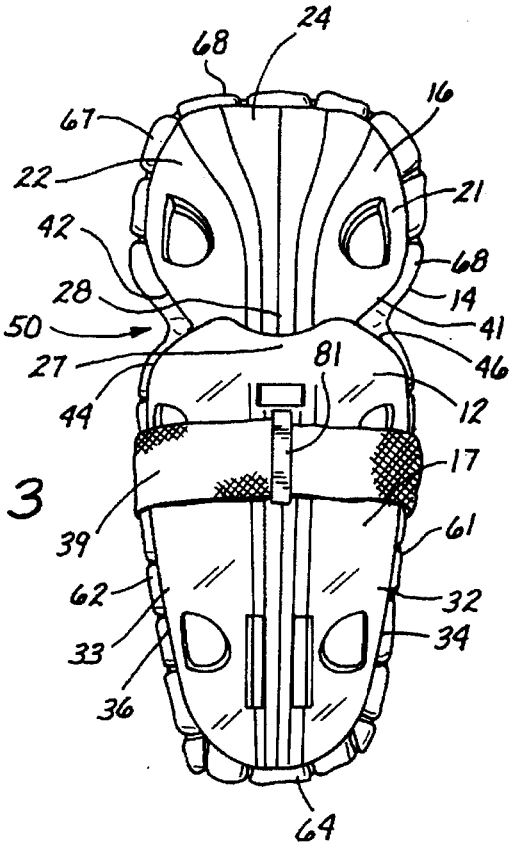
FIG. 3 is a view similar to FIG. 1 with the cloth cover removed.

As illustrated in FIGS. 1–4 and in the form shown, the shell is made up two shells 16 and 17, 16 being an upper shell adapted to cover the knee and shell 17 being the lower shell adapted to cover a portion of the leg below the knee. While the shells 16 and 17 may take a variety of configurations and may be made of a variety of materials, one such suitable material is a durable and hard plastic such as polyethylene or polypropylene and the like. In general and as seen in FIGS. 1 and 3, the upper shell 16 is configured to include side panels 21 and 22 which are curved back from the front to protect the inner and outer portion of the knee and a curved upper panel 24 which covers and tends to protect the upper part of the knee.

The lower shell 17, may be formed of the same material as the upper shell 16 and is hingedly mounted to the upper shell. The hinge may be of a variety of forms but one typical form is that of a strap and slot 26, as shown in FIG. 4 in which a portion of the padding has been removed to show the hinge. As seen in FIGS. 1 and 3, the upper portion 27 of the lower shell 17 overlies the lower portion 28 of the upper shell 16 so that when there is bending of the leg, the lower front portion of the knee remains protected.

The lower shell 17 also includes curved side walls 32 and 33 to fit around the side portions of the leg below the knee and to protect the same. In the form shown, the lower shell is wider at the top than at the bottom and includes side edges 34 and 36 which are inclined towards the front of the leg. The lower shell may also include provision for mounting a strap 39 to secure the knee pad assembly 10 in place on the leg with the upper shell 16 positioned over the knee. The strap may be of the type using a VELCRO hook and loop fastener attachment.

Each lower edge 41 and 42 of the upper shell is inclined upwardly, as seen in FIGS. 1 and 3, while each upper edge 44 and 46 of the lower shell 17 is inclined downwardly to form generally a V-shaped notch 50 on each side of the knee pad assembly 10. This V-notch not only assists in easy relative flexible movement between the upper and lower shells, but provides a more important function, to be described. The padding member 14 also includes V-notches 53 (FIG. 4) on each side thereof which are generally located adjacent the V-notches formed by the upper and lower shell edges. Again, the V-notches of the padding member assists in easy flexing of the padding member as the shell move relative to each other, but cooperate with the V-notches of the shells to hold the cloth member 15 in place.

As seen in FIGS. 1 and 3, the padding member 14 is preferably formed of a single piece of foam and extends from below the lower end of the lower shell to the upper end of the upper shell. In a preferred form, the foam is thicker in the peripheral regions than in the portions thereof which are directly to the rear of the upper and lower shells. The peripheral regions are the lateral regions 61 and 62 lateral of the lower shell, the lower region 64 and the regions 66 and 67 on each side of the upper shell and the upper region 68, all of which extend beyond the edges and sides and top and bottom of the upper and lower shells. In this way, the wearer is protected from having the edges, top and bottom of the shells, from irritating or digging into the portion of the leg or knee along these edge and top and bottom portions of the shells.

The pad 14 may be attached to the shells by any one of several different mechanisms. One such mechanism is illustrated in FIGS. 3 and 4. In this form, the upper and lower shells are each provided with inwardly extending tabs 71, the tabs being in generally axial alignment, the lower shell including two sets of two each and the upper shell including one set of two. The foam padding includes a series of slots 73 each of which receives one of the tabs 71 such that the foam padding is held in a curved configuration against the upper and lower shells, as seen in the drawings. Also seen in FIG. 3 is a mechanism to secure the knee pad assembly 10 releasably to the leg and knee. In the form illustrated, the lower shell includes a slot 81 through which a strap 39 extends, the ends of the strap being provided with means to secure the ends together. A VELCRO fastener made up of hooks and loops is quite suitable for this purpose. The knee pad assembly is adjusted on the front of the leg with the upper shell over the knee and the strap is arranged around the leg in the calf region and the ends are secured together.

As seen in FIG. 1, the cloth member 15 is assembled over both the shell members 16 and 17 and the padding member 14 so as to cover completely not only the interior portion of the padding member opposite the shells, but covers the top and bottom edges of the padding as well as the side edges of the padding. In the form shown, the cloth member 15 includes portions 86 and 87 that cover the side edges of the lower shell and a portion 88 that covers the bottom portion of the lower shell. In the form shown, the cloth member includes an upper section 90 which covers essentially the entire upper shell 16. This structure assists in maintaining the cloth member in place on the shell members.

One of the important aspects of this invention is that the cloth member 15 includes a V-shaped side configuration 92 along each side to fit with the V-notches 53 of each side of the padding. This arrangement tends to assist in preventing the cloth member 15 from moving axially and laterally with respect to the upper and lower shells. In effect, the cloth member remains in the proper orientation with respect to the shells 16 and 17.

In a preferred form, the cloth member 15 may be of any of a variety of cloth materials. In accordance with this invention the cloth member is of relatively soft cloth similar to that used for sweat shirts, although other cloth materials may be used. For example, the cloth member may be made of fleece with the fleece side positioned against the skin.

Figure 5:
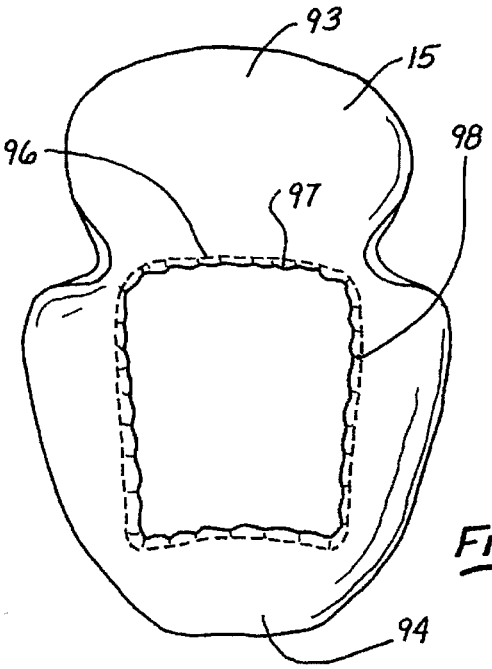
FIG. 5 is a plan view of the cloth cover removed from the knee pad assembly and as seen from the direction as seen in FIG. 2.

As shown in FIGS. 5 and 6, the cloth member 15 includes an upper section 93 and a lower section 94 which fit over the upper and lower shells, as illustrated. The surface 95 is that which is located between the foam and the skin while face sections 93 and 94 fit over the shells. The lower end 96 of the upper section 93 includes an internal elastic member 97 extending transversely while the lower face section includes a elastic member 98 along the periphery and in a generally arcuate arrangement, as illustrated. It is this elastic member 98 which assists in securing the lower section 94 to the lower shell 17 and which overlaps the edge of the foam member as seen and described in connection with FIG. 1. It is apparent that various colors of fabric and types of fabric may be used, the selection mandated principally by comfort and the ability to remove and clean the cloth member 15 easily, as by laundering. It is also apparent that the portion of the cloth member 15 which faces the skin may be of fleece or the like while the remainder which covers the side edges of the lower shell and the entire upper shell may be of some less expensive but functional material.

It is also apparent from FIG. 5 that the upper section 93 is of a transverse dimension less than that of the lower section 94. This view also clearly shows the V-notches 92 which fit with the V-notches 53 on each side of the padding.

The knee pad assembly of this invention offers several advantages such as comfort, which encourages the use of protective knee pads, ease of cleaning of the cloth member and reduction of movement and discomfort of knee pads which do not include a cloth member. The knee pad may take a variety of configurations but it is important, in accordance with this invention, that a cloth member be assembled to the Knee pad to provide the advantages herein described. The knee pad assembly of this invention may be used in motorcycling, mountain biking, and made in sizes to fit adults and children. These same pads may be used for other sports such as hockey knee pad assemblies and in-line skating pads. The knee pad assembly of this invention may also be used by those whose employment require that they work on their knees, e.g., carpet installers, supermarket stock personnel and the like. In fact the basic design may be used for elbow pads for adults and children with only slight and obvious modification of the shells.

It will also be apparent that the structure of the knee pad or elbow pad may vary from that illustrated and described. A wide variety of knee pad and protective pad structures may be used, for example, those knee pads available commercially under the designation AXO, Thor, Acerbis, Fox to mention only a few.

It will be apparent from the foregoing detailed description that many variations and modifications may be made to the knee pad assembly of this invention without departing from the scope of the present invention as set forth in the appended claims.

What is claimed is:

1. A pad assembly for use as a protective device to protect from certain types of injury comprising:

an outer shell member comprised of an upper and lower shell member, said upper shell being configured to fit over a specified portion of a person's body and said lower shell being configured to fit over another portion of a person's body adjacent to said specified portion, said outer shell member having an inner surface which faces a person's body and an outer surface which faces away from a person's body, means to secure said shells together for relative hinged movement whereby the other portion of a person's body may be flexed while the upper shell remains over the specified portion of a person's body, foam padding received on the inner surface of said outer shell member adapted to face the person's body and including a peripheral portion extending beyond a periphery of said outer shell member, cloth means overlying said foam padding on the surface thereof facing the person's skin and spaced from said shell member by said foam padding, said cloth means including a portion adapted to fit over an outer surface of said foam padding and a peripheral portion thereof which extends over a portion of the outer surface of said outer shell member, and means to releasably secure the shell member and assembled foam padding and cloth means to a portion of a person's body to be protected from abrasions and the like.

2. A pad assembly as set forth in claim 1 wherein the upper shell is configured to fit over a person's knee and the lower shell is configured to fit over the portion of a person's leg below the knee.

3. A pad assembly as set forth in claim 1 wherein said cloth means covers the outer surface of the upper shell and extends about the periphery of the foam padding extending about the periphery of the lower shell.

4. A pad assembly as set forth in claim 2 wherein said foam padding is affixed to each of the upper and lower shells, The peripheral portion of the foam padding which extends beyond the periphery of said lower shell which is thicker than the foam padding which underlies said lower shell.

5. A pad assembly as set forth in claim 2 wherein the peripheral portion of the cloth means includes an upper section which overlies the inner and outer surfaces of the upper shell, and a lower section which extends over the peripheral portion of said foam padding which is in facing relation with said lower shell.

6. A pad assembly as set forth in claim 2 wherein a V-shaped notch is formed between an upper portion of the lower shell and a lower portion of the upper shell.

7. A pad assembly as set forth in claim 6 wherein a V-shaped notch is formed in the portion of the foam padding extending beyond the V-shaped notch formed by said upper and lower shells.

8. A pad assembly as set forth in claim 7 wherein said cloth means includes a V-shaped notch which receives the V-shaped notch of said foam padding.

9. A pad assembly as set forth in claim 5 wherein in the non-assembled condition, the upper portion of said cloth means which ultimately overlies said upper shell is of a transverse dimension greater than the transverse dimension of the lower portion of said cloth means.

10. A pad assembly as set forth in claim 2 wherein said cloth means covers the outer surface of the upper shell and extends about the periphery of the foam padding extending about the periphery of the lower shell, said foam padding being affixed to each of the upper and lower shells, the peripheral portion of the foam padding which extends beyond the periphery of said lower shell is thicker than the foam padding which underlies said lower shell, the peripheral portion of the cloth means includes an upper section which overlies the inner and outer surfaces of the upper shell, and a lower section over the peripheral portion of said foam padding which is in facing relation with said lower shell, a V-shaped notch being formed between an upper portion of the lower shell and a lower portion of the upper shell, a V-shaped notch being formed in the portion of the foam padding extending beyond the V-shaped notch formed by said upper and lower shells, and said cloth means including a V-shaped notch which receives the V-shaped notch of said foam padding.

* * * * *